US007568653B2

(12) United States Patent
Zeiron

(10) Patent No.: US 7,568,653 B2
(45) Date of Patent: Aug. 4, 2009

(54) ADAPTER FOR A SOLID OR CORELESS ROLL OF HYGIENE PAPER

(75) Inventor: Kent Zeiron, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 11/946,887

(22) Filed: Nov. 29, 2007

(65) Prior Publication Data

US 2008/0067281 A1 Mar. 20, 2008

Related U.S. Application Data

(63) Continuation of application No. PCT/SE2005/000832, filed on Jun. 1, 2005.

(51) Int. Cl.
*B65H 49/18* (2006.01)

(52) U.S. Cl. ..... 242/596.7; 242/599.4

(58) Field of Classification Search ..... 242/596, 242/596.4, 596.7, 598.3, 599.4, 608
See application file for complete search history.

(56) References Cited

U.S. PATENT DOCUMENTS

| | | | | |
|---|---|---|---|---|
| 4,383,656 | A * | 5/1983 | Campbell | 242/598.3 |
| 5,501,415 | A * | 3/1996 | Harris et al. | 242/596.7 |
| 5,791,588 | A * | 8/1998 | Lindstrand | 242/608 |
| 6,082,664 | A * | 7/2000 | Phelps et al. | 242/596.7 |
| 6,092,758 | A | 7/2000 | Gemmell | |
| 6,360,985 | B1 * | 3/2002 | Phelps et al. | 242/596.4 |
| 2002/0074450 | A1 | 6/2002 | Tramontina et al. | |
| 2002/0170996 | A1 * | 11/2002 | Fukugawa et al. | 242/160.4 |

FOREIGN PATENT DOCUMENTS

| | | | |
|---|---|---|---|
| EP | 0 580 561 | A2 | 1/1994 |
| EP | 0 729 724 | A1 | 9/1996 |
| WO | 2004/056250 | A1 | 7/2004 |

* cited by examiner

*Primary Examiner*—William A Rivera
(74) *Attorney, Agent, or Firm*—Young & Thompson

(57) ABSTRACT

An adapter (1) for a coreless or solid roll (R) of hygiene paper includes a first end (2) adapted to be attached in a dispenser and a second end (3) adapted to be attached to a side of a coreless or solid paper roll (R). The second end (3) of the adapter (1) includes a planar surface provided with an adhesive (4). A coreless or solid roll (R) of hygiene paper provided with such adapters, and a method for attaching adapters to a solid or coreless roll, are also disclosed.

22 Claims, 3 Drawing Sheets

ADAPTER FOR A SOLID OR CORELESS ROLL OF HYGIENE PAPER

CROSS REFERENCE TO RELATED APPLICATION

This is a continuation of international application PCT/SE2005/000832 filed on Jun. 1, 2005, which designated the United States of America.

FIELD OF THE INVENTION

The present invention relates to an adapter for a solid or coreless roll of hygiene paper, the adapter comprising a first end adapted to be attached in a dispenser and a second end adapted to be attached to a side of a solid or coreless paper roll, and also to a solid or coreless roll of hygiene paper provided with such adapter and a method for attaching adapters to a paper roll.

BACKGROUND OF THE INVENTION

Rolls of hygiene paper, i.e. toilet paper, hand towel paper, kitchen towel paper, industrial wiping paper and the like, are widely used. In households, small rolls with a diameter of 100-150 mm and a weight of 0.1-0.2 kg are usually used whereas in factories, offices and public localities and the like larger rolls, which often are called "jumbo rolls" and which can have a diameter of 150-400 mm and a weight from 0.2-10 kg, are used.

Traditionally, cored rolls have been used. Such rolls are produced by winding the paper around a cylindrical core, typically made of cardboard or plastic material in the form of a hollow cylinder. A drawback with cored rolls is that the presence of an empty space inside the core means that during transport and storing of such rolls a great deal of room is taken up by the cores. Another drawback is that the presence of cores in such rolls complicates the feeding of a full roll from a storage position to a dispensing position in a dispenser for a multiple of rolls, since the empty core must first be moved out of the way. A third problem with cored rolls is that the empty core must be discarded after the paper in the roll has been dispensed.

There are also known coreless rolls. Such rolls are produced by winding a paper web around a mandrel, which is extracted from the winded roll. Coreless rolls also comprise a central opening, which however have a much smaller diameter than the cores of traditional cored rolls. However, the empty space in the center of a coreless roll also takes up room during transport and storing of such rolls, to a not insignificant extent. Moreover, the loads acting on the rolls during handling, storing and transporting may often lead to deformation of the rolls and central openings therein. Such deformations may lead to difficulty of placing the coreless rolls in dispensers and/or to irregularities in the dispensing operation. An advantage with coreless rolls is that no empty core of cardboard or the like remains after dispensing of the paper in the roll.

Solid rolls, which have been introduced recently on the market, do not comprise a core or a central through-going opening, but the central portion of the roll is filled with paper web. A finished solid roll of paper web has the form of a solid cylinder completely filled with paper web and has an essentially homogenous appearance when viewed from the side. The density range of a solid roll is 140-380 kg/m$^3$. The density of the roll is dependent on the tension in the paper web during winding and it may vary slightly for technical reasons.

It is of course possible to intentionally vary the tension in the web in order to vary the density of the produced solid roll, for example in order to have a different density in a central portion than in a peripheral portion. A machine and a method for manufacturing of solid paper rolls are, for example, known from EP 0580561.

In addition to not having a core to be discarded and no central empty space to take room during transport and storing, solid rolls have the further advantage of containing more paper web than cored or coreless rolls having the same size. The use of solid rolls has therefore several advantages.

WO 2004/056250 A1 discloses a dispenser that is specifically constructed for solid paper rolls. This dispenser comprises two projections fitted on opposite dispenser walls between the winding of the roll in or near the center thereof to define a rotational axis.

However, dispensers for hygiene paper rolls are often constructed for dispensing cored rolls so that solid or coreless rolls can not be used in such dispensers. One way to overcome this problem is to provide the coreless or solid rolls with adapters enabling such rolls to be used in dispensers of traditional construction, in which the rolls are suspended to rotate around a determined rotational axis when paper web is drawn out from the dispenser.

U.S. Pat. No. 6,082,664 and U.S. Pat. No. 6,386,479 B1 disclose adapters for solid paper rolls intended to be inserted in central recesses in the rolls defining a rotational axis. In U.S. Pat. No. 6,082,664 the adapters consist of a body having protrusions on opposite end portions whereby one end protrusion is to be inserted into the central recess in the roll and the other protrusion is to be inserted into a slot in the side wall of the dispenser. The protrusions holding the roll between them is urged by a spring device towards each other. In U.S. Pat. No. 6,386,479 two pairs of pins are protruding from the legs of a U-shaped arm. In each pair of pins, one pin is to be inserted into a central recess of the solid roll and the other into a slot in a dispenser wall.

An objective of the present invention is to provide an adapter for a solid hygiene paper roll which is of a simple construction, can easily be adapted to traditional dispensers, does not deform or penetrate the roll and does not need a central hole or recesses in the roll to be functional. A further object of the invention is to provide such an adapter which also can be used for coreless rolls.

SUMMARY OF THE INVENTION

This objective is accomplished by an adapter for a solid or coreless roll of hygiene paper, the adapter comprising a first end adapted to be attached to a dispenser and a second end adapted to be attached to a side of a solid or coreless paper roll, characterised in that the second end of the adapter includes a planar surface coated with an adhesive. The second end of such an adapter can easily be attached directly to the solid or coreless paper roll without any need for a pre-forming of a central recess or the like, and without any risk for deformation or damage of the paper roll or the separate windings thereof. The application of such an adapter on a coreless roll is moreover not made more difficult if the center of the roll is somewhat deformed.

In a preferred first embodiment, the whole of the planar surface of the second end of the adapter is coated with said adhesive.

In a second preferred embodiment, a center portion of the planar surface of the second end of the adapter is free from adhesive. The planar surface of the second end of the adapter can be coated with a pattern of strings of adhesive.

The adhesive is preferably an acrylic adhesive system, such as a pressure sensitive acrylic adhesive.

The first end of the adapter is advantageously adapted to be rotatably attached in a dispenser and the planar surface of the second end of the adapter is preferably the outermost surface of the second end.

In an alternative variant, preferably to be used for coreless rolls, the second end of the adapter can be provided with a protrusion in its center portion, the protrusion having a conical shape. Such a protrusion will facilitate the centering of the adapter on the roll.

The planar surface of the second end of the adapter may be textured or embossed.

The invention also relates to a solid or coreless roll of hygiene paper, characterised in that it is provided with at least one adapter comprising a second end including a planar surface adhesively attached to a side of the roll.

Preferably, the roll is provided with two of the above described adapters adhesively attached to opposite sides of the roll opposing each other.

The roll has preferably a density of 200 kg/m$^3$ or more.

When the adapters are to be manually attached to the roll, the roll advantageously comprises markings for visually disclosing the center of the roll and each adapter comprises markings complementary thereto.

The invention also relates to a method for attaching adapters to a solid or coreless core of hygiene paper, which comprises the step of adhesively attaching a planar surface of a second end of an adapter to a side of the roll.

Preferably, the planar surface of a second end of an adapter is coated with adhesive before pressing the planar surface against the side of the roll.

Alternatively, a side of the roll is coated with adhesive before pressing the planar surface against the side of the roll.

BRIEF DESCRIPTION OF THE DRAWINGS

The present invention will now be described with reference to the enclosed figures, of which.

DESCRIPTION OF EMBODIMENTS

Figure 1:
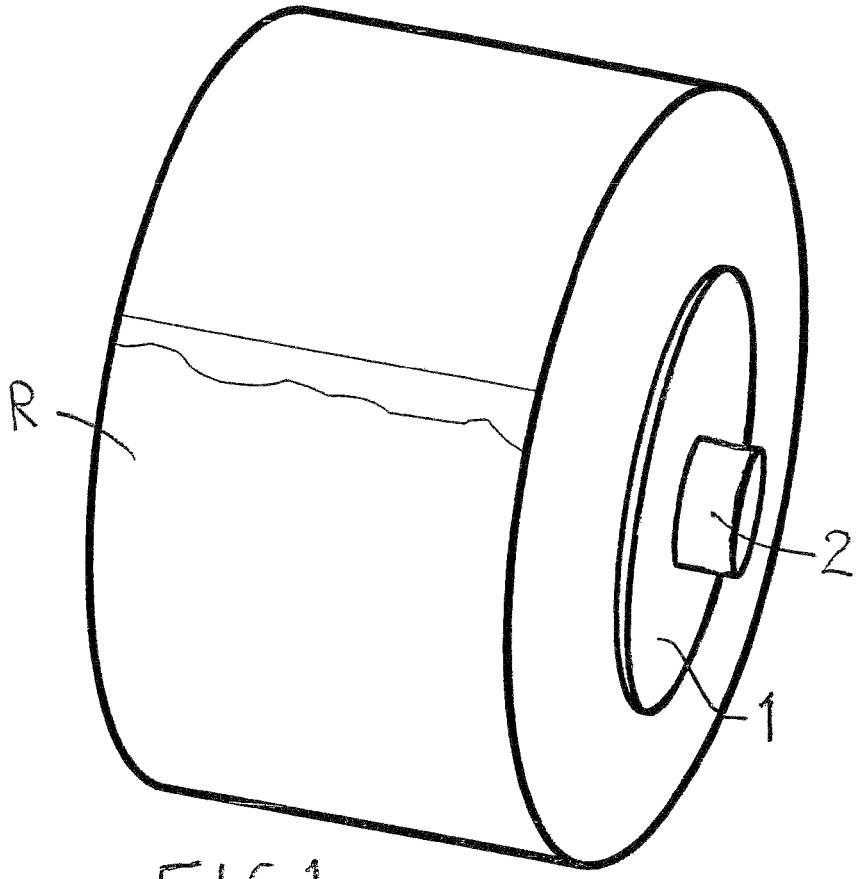
FIG. 1 discloses a perspective view of a solid hygiene paper roll provided with an adapter according to a first preferred embodiment of the invention, FIG. 2 discloses a perspective view of the adapter in FIG. 1, FIG. 3 discloses a perspective view of an adapter according to a second embodiment, FIGS. 4-8 disclose plan views of the second ends of an adapter according to FIG. 1 provided with different adhesive patterns, and FIG. 9 discloses different configurations of the planar surface of the second end of an adapter according to the invention.

In FIG. 1, a solid toilet roll R provided with an adapter 1 according to a first embodiment of the present invention is shown. The adapter 1 has a first cylindrical end 2 to be inserted into a slot in the wall of a suitable dispenser of conventional construction (not shown). The second end 3 of the adapter 1 consists of a disk being coated with a layer 4 of adhesive (see FIG. 2), which in FIG. 1 is attached to the vertical side of the roll R.

It has surprisingly been shown that the dispensing of a toilet roll R provided with such an adapter 1 on its opposite vertical sides functions well in a dispenser of conventional construction having slots for the receiving of cylindrical pins or the like. In one exemplary use the toilet roll used contained 280 meters of one ply paper, had a density of 250 kg/m$^3$, a diameter of 180 mm, and a width of 100 mm. The adapters used had the configuration shown in FIG. 1 and were made of Polyamide 6,6, and had an area of 12.5 cm$^2$ coated with a double coated adhesive tape from Nitto, Japan having the trade name Nitto 510 being applied across the planar end surface of the second end of the adapter. The coated area was 8.3 cm$^2$. The paper could be drawn out without damage thereto and the attached windings of paper came loose easily from the adapter when so much paper has been drawn out that the edges of outermost windings of paper were within the limits of the area of the adhesive coating on the adapter.

Other double coated adhesive tapes that are suitable for the present invention are Nitto 5033× from Nitto Denko Europe and 665 double coated tape from 3M.

The adapter according to the present invention is thus of a very simple construction and can be attached to solid paper rolls without the need for any recesses or the like therein as for the adapters according to U.S. Pat. No. 6,082,664 and U.S. Pat. No. 6,386,479 B1 and without the risk for damaging the roll by the insertion of protrusions between the windings thereof as in the adapter according to WO 2004/056250 A1. The adapter according to the present invention can also easily be adapted to different sizes of rolls by simply enlarging or reducing the area of the adhesive coating, as the case may be. It is thus possible to construct an adapter according to the invention having such a large disk 3 that the adaptation of the adapter to rolls of different sizes and/or weights is made only by varying the area of the adhesive.

The adhesive to be used for an adapter according to the invention can be rubber based, acrylic based or silicone based adhesives. Advantageously, an acrylic adhesive system, and preferably pressure sensitive acrylic adhesives, are used.

The adapter could be made of plastic material, for example polyamide, polyethylene, polyester or polypropylene. Also cardboard, wood or metal or combinations of these materials could be used.

Figure 2:
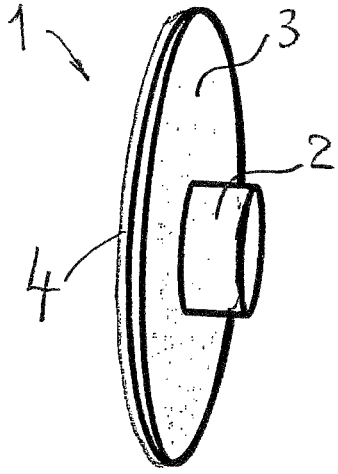
Figure 3:
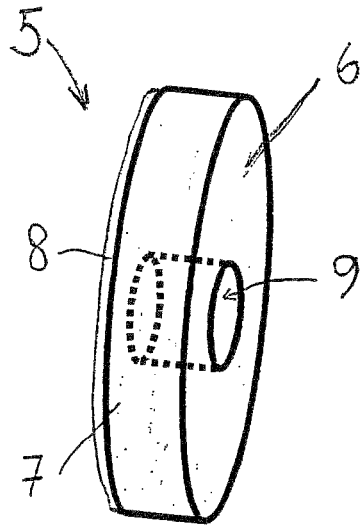

The adapter need not have a second end of the configuration shown in FIGS. 1 and 2, it is only necessary that it has a planar end surface with an adhesive coating of a sufficient size. In FIG. 3 is shown an adapter having the shape of a short cylinder 5 having a first end 6 to co-operate with a dispenser and a second end 7 having a planar surface coated with an adhesive layer 8. The first end 6 of the adapter 5 has a central opening 9 or recess in which a protrusion in a side wall of a dispenser is to be inserted in order to define the rotational axis for a paper roll. Thus, the first end of the adapter can within the limits of the present invention have any configuration necessary in order to be able to co-operate with a dispenser of a certain construction. For example, it is possible to construct the first end of the adapter to contain bearings facilitating rotation of the adapter and a roll attached thereto. For heavy rolls, such as jumbo rolls, it may be advantageous to provide the first end of the adapter with bearings.

It is also not necessary that the adapter as a whole be rotatably attached to a dispenser. The adapter can consist of two or more parts being rotatably attached to each other, thereby enabling the roll to rotate in relation to the dispenser to which it is attached by the first end of the adapter.

The adapter can also be attached to a part in the dispenser that is rotatably attached to other parts of the dispenser.

Figure 4:
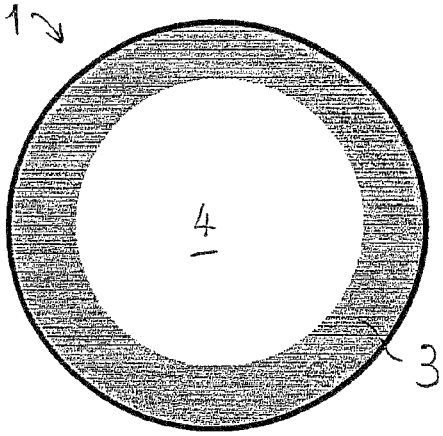

In FIG. 4, the second end 3 of the adapter 1 is shown in a plan view, the adhesive area 4 being the white area in the center of the end surface of the second end. When paper rolls having such adapters are used in a dispenser with such an embodiment of the adhesive area, the paper will break from the remaining rod of paper when almost all the paper has been depleted from the roll. This is due to the fact that the diameter of the roll has been reduced to such an extent that the length of the lever of the force acting on the paper drawn out from the dispenser is so small that the force required to create the required moment for rotating the roll is larger than the strength of the paper. However, when this is likely to occur only a small portion of paper remains in the roll, such portion being less than about 1 m. In some applications of the present invention this phenomena is advantageous since the small remaining amount of paper and the two adapters attached thereto can be discarded as a unit.

Figure 5:
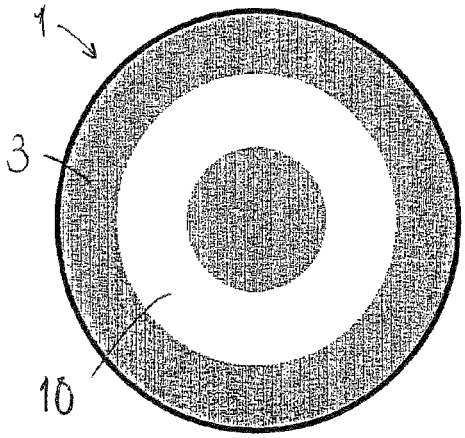

In other applications it is desirable that all paper is drawn out of the dispenser. In such a case, a central area of the end surface of the second end 3 of the adapter 1 is left free of adhesive. Such a pattern of adhesive is shown in FIG. 5, which is a similar view to FIG. 4 of the end surface of the second end 3 of an adapter 1 provided with an adhesive layer 10 having an annular shape. When such adapters are used in a dispenser and the diameter of the paper roll has been reduced due to depletion of paper from the roll, so that the outermost winding on the remaining roll leaves the inner diameter of the annular adhesive layer 10 on the end surface 3 of the adapter 1, the roll will loosen from the adapters and be drawn out of the dispenser. The adapters will be collected inside the dispenser. Such a pattern of adhesive may be useful on adapters to be used in dispensers containing several rolls of hygiene paper. Such a pattern is also useful for coreless rolls since there is no need for adhesive on the area of the adapter covering the center hole in such a roll.

Figure 6:
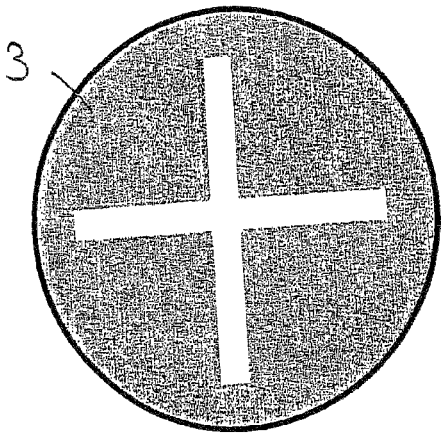
Figure 7:
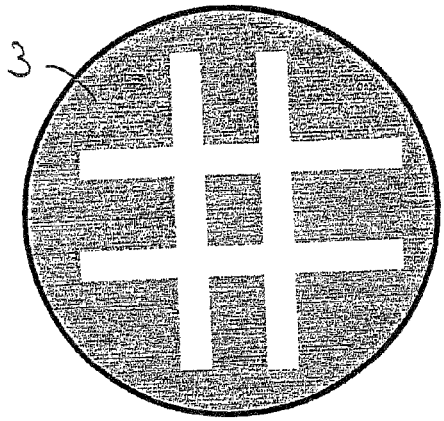
Figure 8:
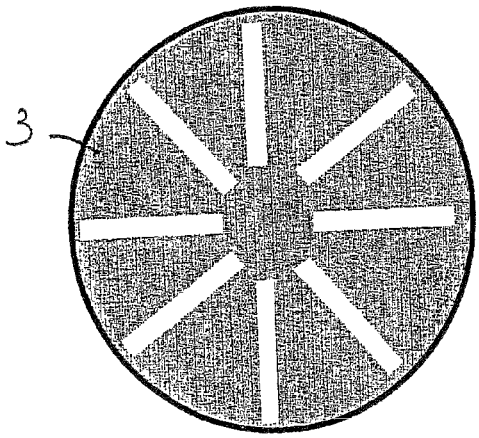
Figure 9:
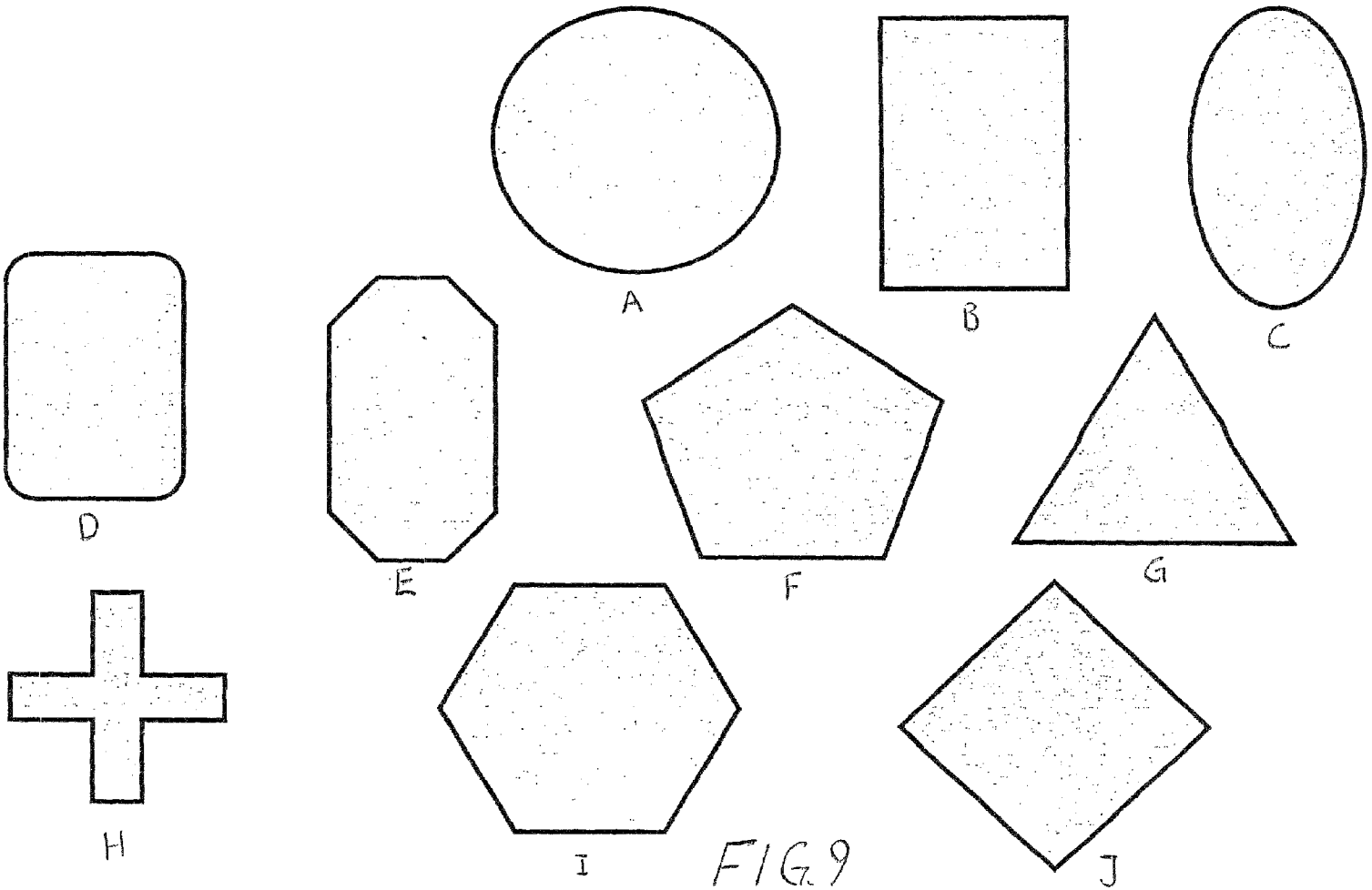

The pattern of adhesive provided on the end surface of the second end of an adapter according to the present invention need not be circular or annular but can have any shape as long as the total area of the adhesive coating is sufficient to hold the weight of the paper roll to which it is intended to be attached. In FIGS. 6-8 examples of possible patterns of adhesive is shown. In these examples the patterns of adhesive, which are the white portions of the figures, are formed by strings of adhesive applied on an adapter having a circular end surface.

The planar end surface of the adapter need not be circular but can have any shape as long as it allows a sufficiently large adhesive coating to be provided thereon. In FIG. 9A-J non-exhaustive examples of possible shapes of the planar end surface of an adapter according to the present invention are shown. If, for example, a cross-like pattern of adhesive in accordance with FIG. 6 is used then a similar configuration of the planar end surface of the adapter may be used, see FIG. 9H. Moreover, the planar end surface of the second end of the adapter can be annular which may facilitate the coating of an annular pattern of adhesive on the planar end surface.

The planar end surface of the adapter can be smooth but can also be textured or embossed, wholly or in parts. Such discontinuities on the planar end surface may be used to locally control the force per unit area with which the adapter adhere to the roll. The texture or pattern of embossments can further be the same over the whole end surface or different in different parts thereof.

The adhesive is either coated directly onto the planar end surface of the second end of the adapter or it is applied using a double coated adhesive tape. It is also possible to use adhesives having different properties in different regions of the coating, for example different adhesives in the center region and in a peripheral region.

The adhesive coating on the planar end surface of the second end of an adapter according to the present invention is preferably provided with a protective release layer to be taken off before the adapter is pressed onto the vertical side of a solid roll of hygiene paper.

Adapters according to the present invention are preferably applied by the manufacturer of the solid or coreless rolls of hygiene paper so that the rolls are delivered to the user with applied adapters. Thereby it is ensured that the adapters are correctly applied to the paper rolls with the adapters applied on the vertical sides of the rolls directly opposite to each other.

However, it is also possible within the scope of the present invention to coat the center of the roll with a pattern of adhesive and thereafter press an adapter against such an adhesive coating. Such coating of adhesive on the vertical side of the roll will make it easier for a user to correctly attach an adapter since it functions as an easy target for the user if the perimeter of the adhesive coating on the roll corresponds with the perimeter of the planar surface of the second end of the adapter. A separation between rolls and adapters during transport thereof may also make it easier to pack these articles in a space-saving manner. During such transport the coating of adhesive will of course be provided with a protective release layer.

In order to facilitate manual application of an adapter to the roll, markings on the roll and on the adapter can be provided. For example a cross marking the center point can be provided on the sides of the roll and a corresponding cross can be marked on the side of the adapter opposite to the side to be attached to the roll. The crosses on the side of the roll shall of course have such a size that they extend beyond the periphery of the adapter when attached to the side of the roll.

If the adhesive during application of the adapter on the roll or the adhesive layer directly on the side of the roll penetrate between the windings in the roll it is a risk that the edges of the separate windings be glued together. This can lead to the paper tearing from the edges during unwinding. The occurrence of such penetration mainly depends on the viscosity of the applied adhesive and the density of the roll. In order to eliminate or at least reduce to an insignificant extent such a penetration, a preferred density of the paper roll is 200 $kg/m^3$ or more.

In WO 2004/056250 is disclosed a dispenser for solid rolls in which, during application of a roll, the whole weight of the roll is taken up by a first adapter. After application of the roll the lid of the dispenser is closed and a second adapter in the wall of the lid is thereby applied to the roll. It is of course possibly to use an adapter according to the present invention in such a dispenser instead of the adapter disclosed in this publication. It is however preferable, but not necessary, to in such a case also provide a rotatable support piece in the lid which presses against the side of the roll when the lid is closed.

The described embodiments can of course be modified within the scope of the present invention. The first and second ends of the adapter can for example have other shapes than the shapes shown on the figures and other patterns of adhesive can be used. Moreover, the adapter can have a through-going central hole enabling the center of the roll to be seen during manual application of the adapter. If the adapter is intended for coreless rolls it can advantageously be provided with a projection in its center having the shape of a cone. Such a cone will ensure a proper centering of the adapter and will thus facilitate the application of the adapter onto a roll. However, the loads on the adapter will still be taken up of the adhesive layer. Such a cone can be resiliently affixed to the second end of the adapter so that it can be retracted into a recess or hole in the center of the adapter if such an adapter is applied to a solid roll of hygiene paper. For a coreless roll it is also possible to design the first end of the adapter so as to be retractable into the center hole of such a roll thereby in order to save packaging space. Furthermore, when a double stick tape is used, adhesives having different properties, such as tack, can be used on opposite sides of the carrier. The scope of the invention should therefore only be limited by the content of the enclosed patent claims.

The invention claimed is:

1. An adapter for a solid or coreless roll of hygiene paper, the adapter comprising:

a main body comprising a center portion and an outer portion extending radially outward from the center portion to define a first face and an opposite second face, the second face having a planar surface;

a dispenser adapter included on the first face, the dispenser adapter configured for attachment to a hygiene paper dispenser; and an adhesive layer on the planar surface of the second face, the adhesive layer configured for attachment to a side of a coreless or solid hygiene paper roll, an outermost surface of the adhesive layer defining an outermost extension of the second face in a direction extending from the planar surface.

2. The adapter according to claim 1, wherein the whole of the planar surface is provided with the adhesive layer.

3. The adapter according to claim 1, wherein a central portion of the planar surface is free from adhesive.

4. The adapter according to claim 1, wherein the adhesive layer on the planar surface comprises a pattern of strings of adhesive.

5. The adapter according to claim 1, wherein the adhesive layer comprises an acrylic adhesive system.

6. The adapter according to claim 5, wherein the adhesive system is a pressure sensitive acrylic adhesive.

7. The adapter according to claim 1, wherein the dispenser adapter is configured to be rotatably attached in a dispenser.

8. The adapter according to claim 1, wherein said planar surface is one of a smooth surface, a textured surface, and an embossed surface.

9. The adapter according to claim 1, wherein the dispenser adapter comprises a recess at the center portion configured to receive a protrusion of the dispenser.

10. The adapter according to claim 1, wherein the dispenser adapter comprises a protrusion configured to be inserted into the dispenser.

11. A solid or coreless roll of hygiene paper provided with at least one adapter comprising a first end adapted to be attached in a dispenser and a second end including a planar surface adhesively attached to a side of the roll.

12. The solid or coreless roll of hygiene paper according to claim 11 provided with two adapters, each comprising a second end including a planar surface, said adapters being adhesively attached to opposite sides of the roll.

13. The solid or coreless roll of hygiene paper according to claim 11, wherein the roll has a density of 200 $kg/m^3$ or more.

14. The solid or coreless roll of hygiene paper according to claim 11, wherein the roll comprises markings for visually disclosing the center of the roll, and each adapter comprising markings complementary thereto.

15. A method for attaching an adapter to a solid or coreless roll of hygiene paper, which comprises the step of adhesively attaching a planar surface of a second end of an adapter to a side of the roll, said adapter having a first end adapted to be attached to a dispenser.

16. The method according to claim 15, further comprising providing said planar surface of a second end of an adapter with adhesive before pressing said planar surface against the side of the roll.

17. The method according to claim 15, further comprising providing a side of the roll with adhesive before pressing said planar surface of a second end of an adapter against the side of the roll.

18. The method according to claim 15, wherein the adhesive is an acrylic adhesive system.

19. The method according to claim 15, wherein the adhesive is a pressure sensitive acrylic adhesive.

20. An adapter for a solid or coreless roll of hygiene paper, the adapter comprising:

a main body comprising a center portion and an outer portion extending radially outward from the center portion to define a first face and an opposite second face, the second face having a planar surface at least in said outer portion;

a dispenser adapter included on the first face, the dispenser adapter configured for attachment to a hygiene paper dispenser and protruding from said first face, an outermost surface of the dispenser adapter defining an outermost extension of the first face; and an adhesive layer on the planar surface of the second face, the adhesive layer configured for attachment to a side of a coreless or solid hygiene paper roll, an outermost surface of the adhesive layer defining an outermost extension of at least said planar surface of the second face in a direction extending from the planar surface.

21. The adapter according to claim 20, further comprising:

a protrusion extending from the center portion of the second face.

22. The adapter according to claim 21, wherein, the dispenser adapter is a cylindrical protrusion, and the whole of the planar surface is provided with said the adhesive layer.

* * * * *